US008154477B2

(12) United States Patent
Choi

(10) Patent No.: US 8,154,477 B2
(45) Date of Patent: Apr. 10, 2012

(54) PLASMA DISPLAY APPARATUS INCLUDING A DRIVER SUPPLYING A SIGNAL TO A SCAN ELECTRODE DURING A RESET PERIOD

(75) Inventor: Yoonchang Choi, Gumi (KR)

(73) Assignee: LG Electronics Inc., Seoul (KR)

( * ) Notice: Subject to any disclaimer, the term of this patent is extended or adjusted under 35 U.S.C. 154(b) by 866 days.

(21) Appl. No.: 12/200,988

(22) Filed: Aug. 29, 2008

(65) Prior Publication Data

US 2009/0096720 A1 Apr. 16, 2009

(30) Foreign Application Priority Data

Oct. 10, 2007 (KR) ..... 10-2007-0102169

(51) Int. Cl.
*G09G 3/28* (2006.01)

(52) U.S. Cl. ..... 345/68

(58) Field of Classification Search ..... 345/37, 345/41, 60–72; 315/111.21, 111.71, 169.3, 315/169.4; 349/32; 313/582, 583
See application file for complete search history.

(56) References Cited

U.S. PATENT DOCUMENTS

| | | | | |
|---|---|---|---|---|
| 2004/0233134 | A1* | 11/2004 | Shindo et al. | 345/63 |
| 2006/0103599 | A1* | 5/2006 | Cho et al. | 345/67 |
| 2007/0001935 | A1* | 1/2007 | Moon | 345/68 |

FOREIGN PATENT DOCUMENTS

| | | | |
|---|---|---|---|
| CN | 1770240 | A | 5/2006 |
| CN | 1892761 | A | 1/2007 |
| EP | 1717786 | A2 | 11/2006 |
| EP | 1990795 | A1 | 11/2008 |
| WO | WO2007099905 | A1 | 9/2007 |

OTHER PUBLICATIONS

Chinese Office Action dated Jan. 8, 2010 for Application No. 200810161432.5, in English translation, 7 pages.

European Search Report dated Jan. 25, 2010 for Application No. 08165026.9, 9 pages.

* cited by examiner

*Primary Examiner* — Chanh Nguyen
*Assistant Examiner* — Ram Mistry
(74) *Attorney, Agent, or Firm* — Fish & Richardson P.C.

(57) ABSTRACT

A plasma display apparatus and a method of driving the same are disclosed. The plasma display apparatus driven in a frame comprised of a plurality of subfields includes a plasma display panel including a scan electrode and a sustain electrode, and a driver. The driver supplies a first signal, that rises from a first voltage to a second voltage, is maintained at the second voltage during a predetermined period of time, and falls from the second voltage to a third voltage smaller than the first voltage with a slope, to the scan electrode. The predetermined period of time is set at different values in at least two subfields.

8 Claims, 9 Drawing Sheets

FIG. 6

| Image gray level | Image quality | power consumption |
|---|---|---|
| 0%<br>First gray level<br>51%<br>Second gray level<br>100% | Reduction<br>↓<br>Increase | Small<br>↓<br>Large |

| First period: second period | Light center of subfields | Uniformity of wall charges |
|---|---|---|
| 1 : 1 | △ | △ |
| 1 : 2 | ○ | ○ |
| 1 : 3 | ◎ | ◎ |
| 1 : 4 | ◎ | ◎ |
| 1 : 5 | ◎ | ◎ |
| 1 : 6 | ○ | ◎ |
| 1 : 7 | △ | ◎ |

PLASMA DISPLAY APPARATUS INCLUDING A DRIVER SUPPLYING A SIGNAL TO A SCAN ELECTRODE DURING A RESET PERIOD

This application claims the benefit of Korean Patent Application No. 10-2007-0102169 filed on Oct. 10, 2008, which is incorporated herein by reference for all purposes as if fully set forth herein.

BACKGROUND

1. Field

An exemplary embodiment of the invention relates to a plasma display apparatus and a method of driving the same.

2. Description of the Background Art

A plasma display apparatus includes a plasma display panel and a driver for driving the plasma display panel.

The plasma display panel has the structure in which barrier ribs formed between a front panel and a rear panel forms unit discharge cell or a plurality of discharge cells. Each discharge cell is filled with an inert gas containing a main discharge gas such as neon (Ne), helium (He) or a mixture of Ne and He, and a small amount of xenon (Xe). The plurality of discharge cells form one pixel. For example, a red discharge cell, a green discharge cell, and a blue discharge cell form one pixel. When the plasma display panel is discharged by applying a high frequency voltage to the discharge cell, the inert gas generates vacuum ultraviolet rays, which thereby cause phosphors formed between the barrier ribs to emit light, thus displaying an image. Since the plasma display apparatus can be manufactured to be thin and light, it has attracted attention as a next generation display device.

SUMMARY

An exemplary embodiment of the invention provides a plasma display apparatus and a method of driving the same capable of improving the discharge efficiency by adjusting a maintenance period of a reset signal supplied to a plasma display panel depending on a gray level of an image.

Additional features and advantages of the exemplary embodiments of the invention will be set forth in the description which follows, and in part will be apparent from the description, or may be learned by practice of the exemplary embodiments of the invention. The objectives and other advantages of the exemplary embodiments of the invention will be realized and attained by the structure particularly pointed out in the written description and claims hereof as well as the appended drawings.

In one aspect, a plasma display apparatus driven in a frame comprised of a plurality of subfields comprises a plasma display panel including a scan electrode and a sustain electrode, and a driver supplying a first signal, that rises from, a first voltage to a second voltage, is maintained at the second voltage during a predetermined period of time, and falls from the second voltage to a third voltage smaller than the first voltage with a slope, to the scan electrode, wherein the predetermined period of time is set at different values in at least two subfields.

In another aspect, a method of driving a plasma display apparatus, including a scan electrode and a sustain electrode, driven in a frame comprised of a plurality of subfields comprises supplying a first signal, that rises from a first voltage to a second voltage, is maintained at the second voltage during a predetermined period of time, and falls from the second voltage to a third voltage smaller than the first voltage with a slope, to the scan electrode, and setting the predetermined period of time at different values in at least two subfields.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 6 is a diagram for explaining a gray level and a maintenance period;

DETAILED DESCRIPTION OF PREFERRED EMBODIMENTS

Preferred exemplary embodiments of the invention will be described in a more detailed manner with reference to the drawings.

Figure 1:
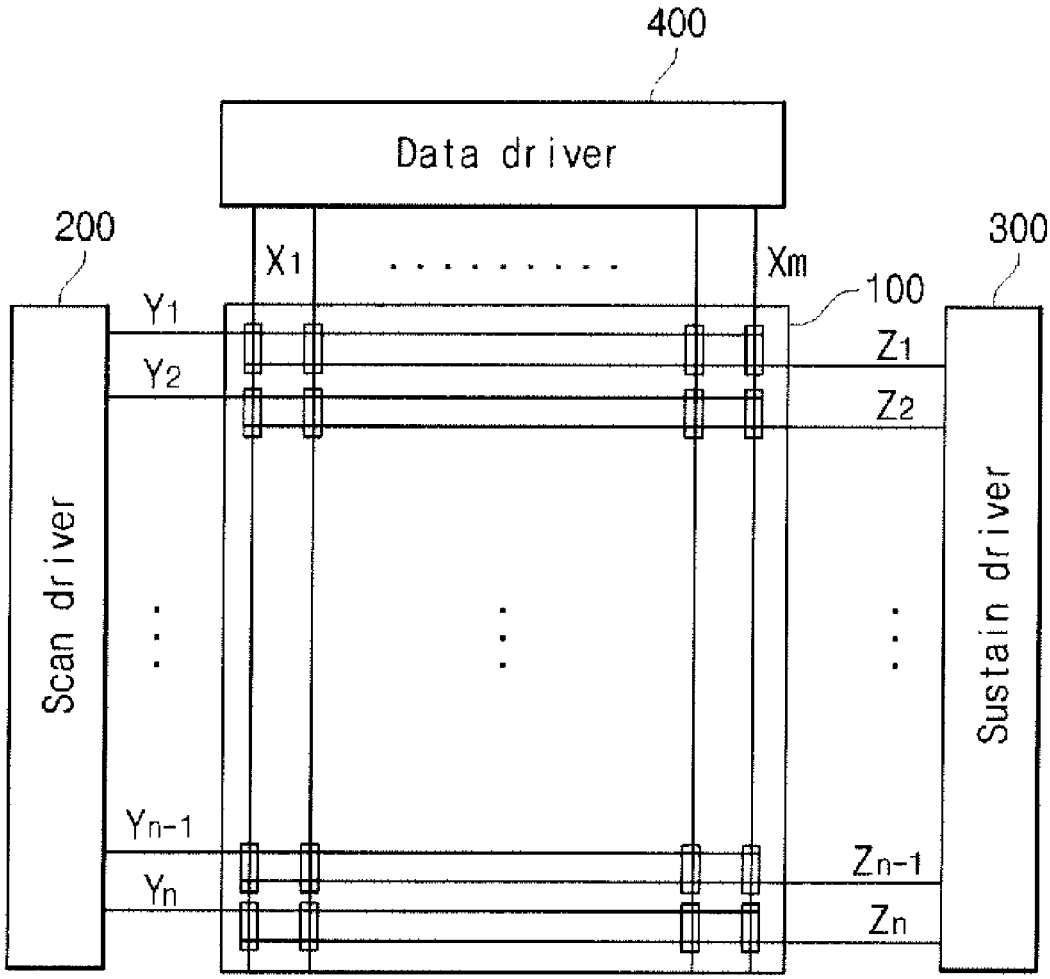
FIG. 1 shows a plasma display apparatus according to an exemplary embodiment of the invention.

FIG. 1 shows a plasma display apparatus according to an exemplary embodiment of the invention.

As shown in FIG. 1, the plasma display apparatus according to the exemplary embodiment includes a plasma display panel 100, a scan driver 200, a sustain driver 300, and a data driver 400.

The plasma display panel 100 includes a front panel (not shown) and a rear panel (not shown) which coalesce with each other at a given distance therebetween. The plasma display panel 100 includes scan electrodes Y1 to Yn, sustain electrodes Z1 to Zn, and address electrodes X1 to Xm.

The scan driver 200 supplies first falling signals to the scan electrodes Y1 to Yn during a pre-reset period prior to a reset period to thereby stably form wall charges on the electrodes. The scan driver 200 supplies reset signals to the scan electrodes Y1 to Yn during the reset period to thereby uniformly form wall charges inside discharge cells.

The reset signal includes a reset rising signal gradually rising to a highest voltage of the reset signal and a reset falling signal gradually falling to a lowest voltage of the reset signal.

The scan driver 200 supplies scan signals to the scan electrodes Y1 to Yn during an address period to thereby select discharge cells to be turned on. The scan driver 200 supplies sustain signals to the scan electrodes Y1 to Yn during a sustain period to thereby generate a sustain discharge inside the discharge cells selected during the address period.

The sustain driver 300 supplies first rising signals to the sustain electrodes Z1 to Zn during the pre-reset period, supplies a sustain bias voltage to the sustain electrodes Z1 to Zn during a set-down period and the address period, and supplies sustain signals to the sustain electrodes Z1 to Zn during the sustain period.

The data driver 400 receives data rapped for each subfield by a subfield mapping circuit (not shown) after being inverse-gamma corrected and error-diffused through an inverse gamma correction circuit (not shown) and an error diffusion circuit (not shown), or the like.

The data driver 400 supplies data signals corresponding to the scan signals to the address electrodes X1 to Xm in response to a data timing control signal received from a timing controller (not shown) during the address period.

Figure 2:
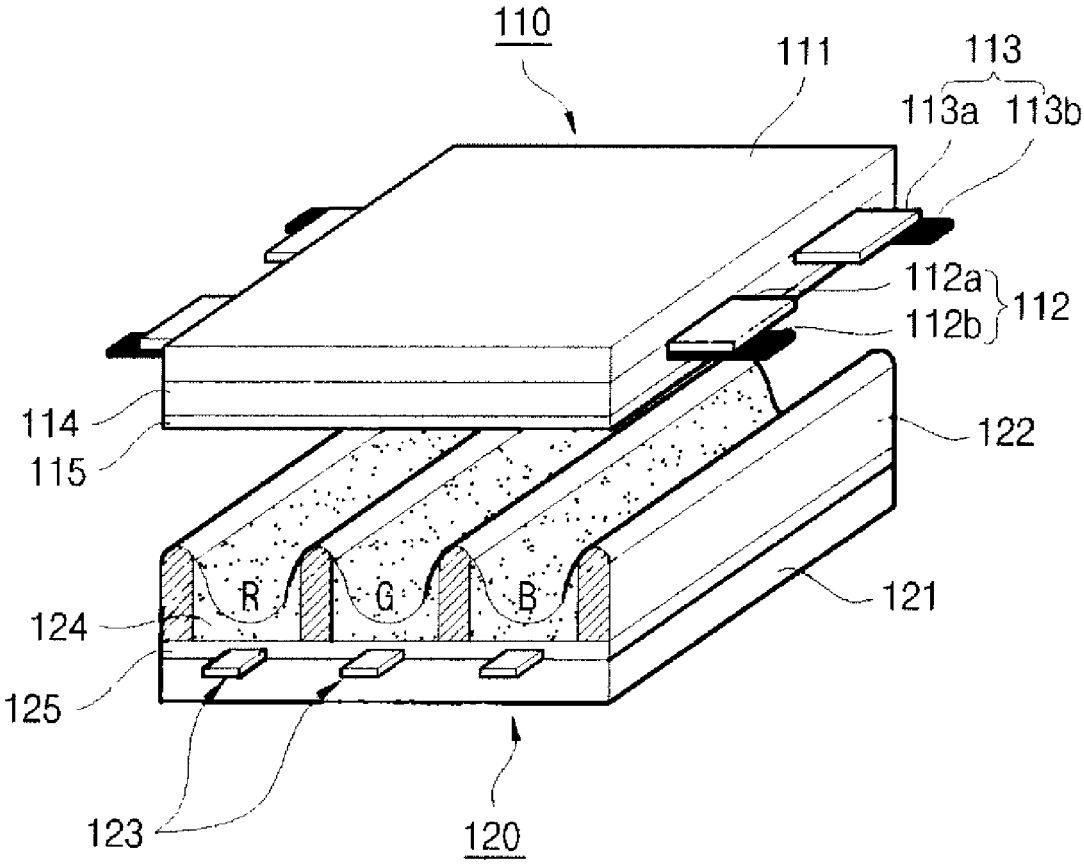
FIG. 2 shows a structure of a plasma display panel of the plasma display apparatus.

FIG. 2 shows a structure of a plasma display panel of the plasma display apparatus.

As shown in FIG. 2, the plasma display panel 100 includes a front panel 110 and a rear panel 120 rich coalesce with each other at a given distance therebetween. The front panel 110 includes a front substrate 111 on which a scan electrode 112 and a sustain electrode 113 are formed parallel to each other. The rear panel 120 includes a rear substrate 121 on which an address electrode 123 is formed to intersect the scan electrode 112 and the sustain electrode 113.

The scan electrode 112 and the sustain electrode 113 generate a mutual discharge therebetween in a discharge cell and maintain a discharge of the discharge cell.

A light transmittance and an electrical conductivity of the scan electrode 112 and the sustain electrode 113 need to be considered so as to emit light generated inside the discharge cells to the outside and to secure the driving efficiency. Accordingly, the scan electrode 112 and the sustain electrode 113 each include transparent electrodes 112*a* and 113*a* made of a transparent material, e.g., indium-tin-oxide (ITO) and bus electrodes 112*b* and 113*b* made of a metal material such as silver (Ag).

An upper dielectric layer 114 covering the scan electrode 112 and the sustain electrode 113 is formed on the front substrate 111 on which the scan electrode 112 and the sustain electrode 113 are formed. The upper dielectric layer 114 limits discharge currents of the scan electrode 112 and the sustain electrode 113 and provides electrical insulation between the scan electrode 112 and the sustain electrode 113.

A protective layer 115 is formed on an upper surface of the upper dielectric layer 114 to facilitate discharge conditions. The protective layer 115 may be formed of a material with a high secondary electron Emission coefficient, for example, magnesium oxide (MgO).

The address electrode 123 formed on the rear substrate 121 applies a data signal to the discharge cell.

A lower dielectric layer 125 covering the address electrode 123 is formed on the rear substrate 121 on which the address electrode 123 is formed.

Barrier ribs 122 are formed on the lower dielectric layer 125 to partition the discharge cells. A phosphor layer 124 emitting visible light for an image display during an address discharge is formed inside the discharge cells partitioned by the barrier ribs 122. The phosphor layer 124 may include a red phosphor layer R, a green phosphor layer G, and a blue phosphor layer B.

Driving signals are applied to the scan electrode 112, the sustain electrode 113, and the address electrode 123 to generate a discharge inside the discharge cells of the plasma display panel. Hence, an image is displayed on the plasma display panel.

FIG. 2 has shown and described only an example of the plasma display panel applicable to the exemplary embodiment of the invention, and thus the exemplary embodiment is not limited thereto.

Figure 3:
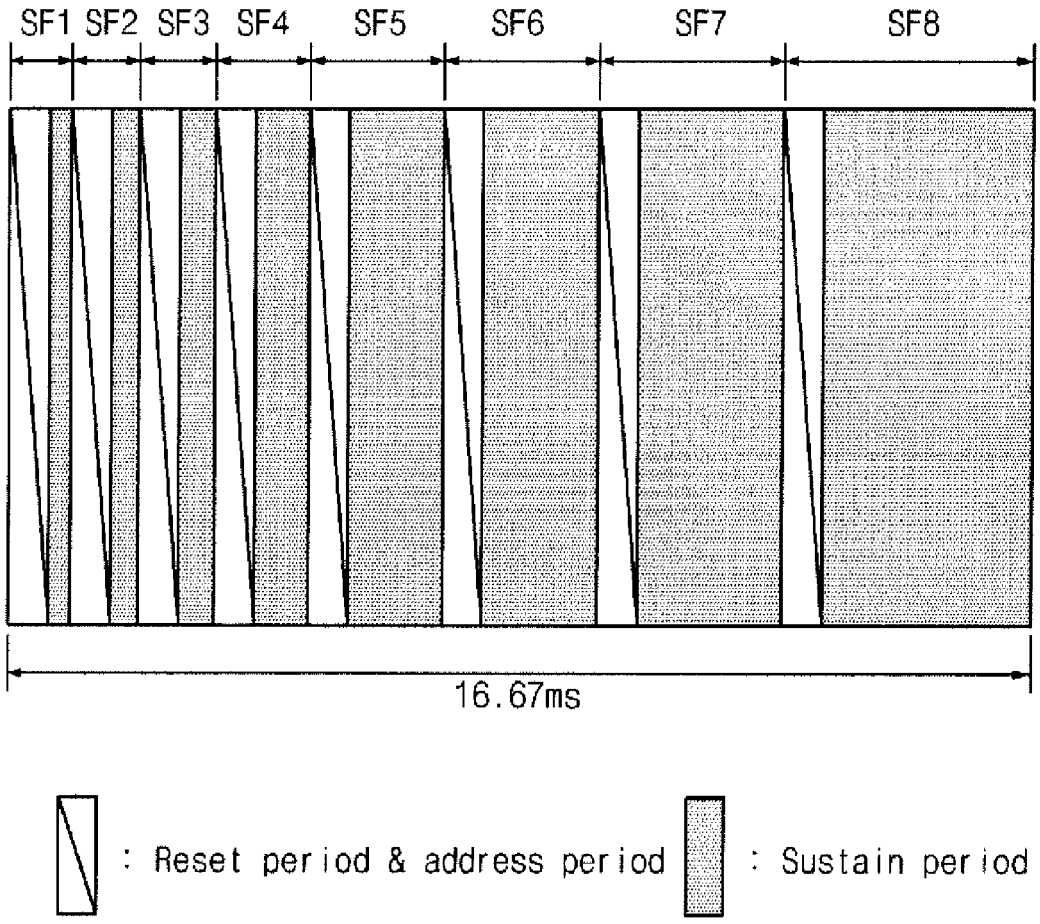
FIG. 3 shows a frame for achieving a gray level of an image in the plasma display apparatus.

FIG. 3 shows a frame for achieving a gray level of an image in the plasma display apparatus.

As shown in FIG. 3, a frame for achieving a gray level of an image in the plasma display apparatus is divided into a plurality of subfields each having a different number of emission times.

Each subfields may be subdivided into a reset period for initializing all the discharge cells, an address period for selecting cells to be discharged, and a sustain period for representing a gray level in accordance with the number of discharges.

For instance, if an image with 256 gray levels is to be displayed, a frame period (i.e., 16.67 ms) corresponding to 1/60 second, as shown in FIG. 3, is divided into 8 subfields SF1 to SF8. Each of the 8 subfields SF1 to SF8 is subdivided into a reset period, an address period, and a sustain period.

The number of sustain signals supplied during a sustain period of a subfield determines a weight value of the subfield. In other words, a predetermined weight value may be assigned to each subfield using a sustain period of each subfield. For instance, in such a method of setting a weight value of a first subfield at $2^0$ and a weight value of a second subfield at $2^1$, a weight value of each subfield can be set so that weight values of subfields increase in a ratio of $2^n$ (where, n=0, 1, 2, 3, 4, 5, 6, 7). An image with various gray values can be displayed by controlling the number of sustain signals supplied during a sustain period of each subfield depending on a weight value of each subfield.

The plasma display apparatus uses a plurality of frames to display an image for 1 second. For instance, 60 frames are used to display an image for 1 second.

While one frame includes 8 subfields in FIG. 3, the number of subfields constituting one frame may be variously changed. For instance, one frame may include 10 or 12 subfields.

The image quality in the plasma display apparatus depends on the number of subfields constituting a frame. For instance, when 12 subfields constitute a frame, the number of representable weight values of an image may be $2^{12}$. When 10 subfields constitute a frame, the number of representable weight values of an image may be $2^{10}$.

Further, while the subfields are arranged in increasing order of weight values in FIG. 3, the subfields may be arranged in decreasing order of weight values. The subfields may be arranged regardless of weight values so as to prevent a contour noise generated when an image is displayed.

Figure 4:
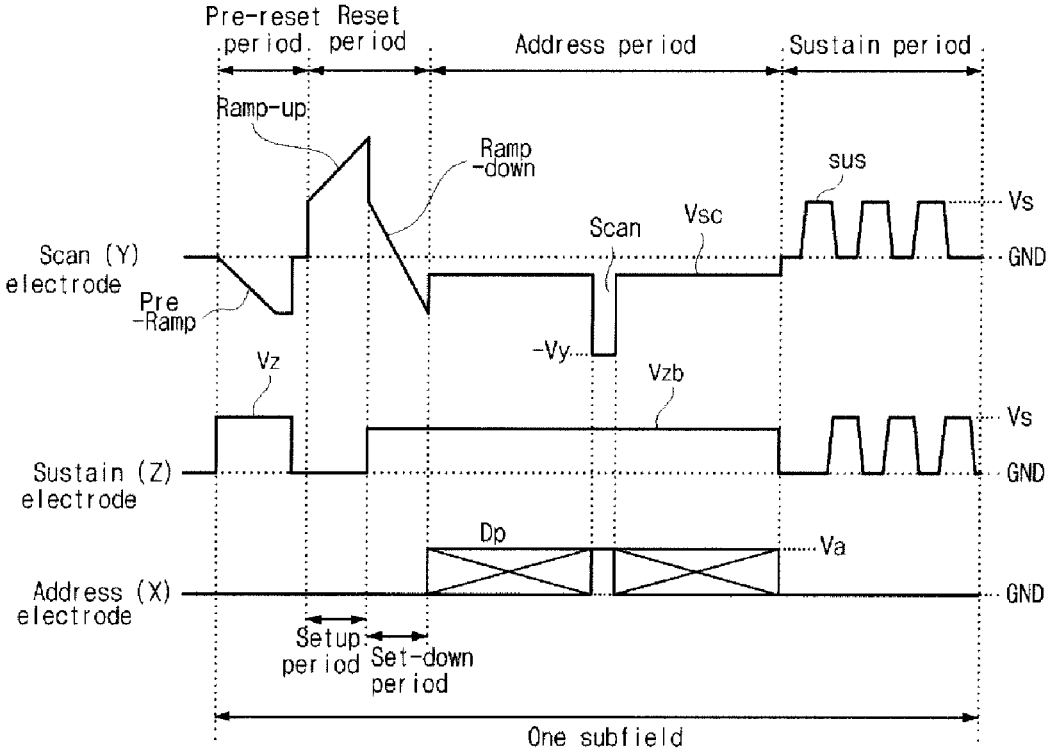
FIG. 4 is a diagram for explaining an operation of the plasma display apparatus.

FIG. 4 is a diagram for explaining an operation of the plasma display apparatus in any one of a plurality of subfields of a frame.

The scan driver 200, the sustain driver 300, and the data driver 400 of FIG. 1 supply driving signals to the scan electrode Y, the sustain electrode Z, and the address electrode X during at least one of a pre-reset period, a reset period, an address period, and a sustain period.

As shown in FIG. 4, a frame may include a pre-reset period prior to a reset period. The scan driver 200 may supply a first falling signal Pre-Ramp, which gradually falls from a ground level voltage GND to a lowest voltage of a reset falling signal, to the scan electrode Y during the pre-reset period.

Although FIG. 4 has shown the case where the first falling signal Pre-Ramp falls to the lowest voltage of the reset falling signal, the exemplary embodiment is not limited thereto. The first falling signal Pre-Ramp may fall to a voltage level smaller or larger than the lowest voltage of the reset falling signal. This may depend on a temperature or surroundings of the plasma display panel.

The sustain driver 300 may supply a first rising signal Vz, whose a polarity is opposite to a polarity of the first falling signal Pre-Ramp, to the sustain electrode Z during the supply of the first falling signal Pre-Ramp.

A voltage of the first rising signal Vz is substantially equal to at least one of a sustain bias voltage Vzb or a sustain voltage Vs corresponding to a highest voltage of a sustain signal SUS. Hence, the first rising signal Vz may be supplied using a sustain bias voltage source or a sustain voltage source.

The first rising signal Vz may depend on the temperature of the plasma display panel, the surroundings of the plasma display panel, or the first falling signal Pre-Ramp corresponding to the first rising signal Vz.

As above, wall charges with a predetermined polarity are accumulated on the scan electrode Y, and wall charges with a polarity opposite the polarity of the wall charges accumulated on the scan electrode Y are accumulated on the sustain electrode Z by supplying the first falling signal Pre-Ramp and the first rising signal Vz to the scan electrode Y and the sustain electrode Z during the pre-reset period, respectively.

Because the frame includes the pre-reset period, a magnitude of a highest voltage of a reset signal can be reduced. Hence the amount of light generated during the reset period can be reduced, and a contrast characteristic can be improved.

The scan driver 200 supplies a reset signal including a reset rising signal Ramp-up and a reset falling signal Ramp-down to the scan electrode Y during the reset period.

More specifically, the scan driver 200 supplies the reset rising signal Ramp-up to the scan electrode Y during a setup period of the reset period. The reset rising signal Ramp-up generates a weak dark discharge inside the discharge cells of the whole screen. Hence, wall charges of a positive polarity are accumulated on the sustain electrode Z and the address electrode X, and wall charges of a negative polarity are accumulated on the scan electrode Y.

The scan driver 200 supplies the reset falling signal Ramp-down, which falls from a positive voltage level lower than a highest voltage of the reset rising signal Ramp-up to a given voltage level lower than the ground level voltage GND, to the scan electrode Y during a set-down period of the reset period, thereby generating a weak erase discharge inside the discharge cells. Hence, wall charges excessively accumulated inside the discharge cells are erased, and the remaining wall charges are uniformly distributed inside the discharge cells to the extent that an address discharge can stably occur.

The reset rising signal Ramp-up and the reset falling signal Ramp-down are supplied in a first subfield of a frame. The first subfield means a first arranged subfield of a plurality of subfields constituting the frame. During reset periods of the remaining subfields except the first subfield, the scan driver 200 may supply a first signal to the scan electrode Y. The first signal rises from a first voltage to a second voltage larger than the first voltage, is maintained at the second voltage during a predetermined period of time, and falls from the second voltage to a third voltage smaller than the first voltage with a slope.

The sustain driver 300 supplies a sustain bias voltage Vzb to the sustain electrode Z during the set-down period and an address period. The sustain bias voltage Vzb reduces a voltage difference between the scan electrode Y and the sustain electrode Z, and thus can prevent the generation of an erroneous discharge between the scan electrode Y and the sustain electrode Z.

The scan driver 200 supplies a scan signal Scan, which falls from a scan bias voltage Vsc to a voltage −Vy, to the scan electrode Y during the address period. The scan bias voltage Vsc may be smaller than the ground level voltage GND. The data driver 400 supplies a data signal Dp corresponding to the scan signal Scan to the address electrode X.

As a voltage difference between the scan signal Scan and the data signal Dp is added to a wall voltage by wall charges produced during the reset period, an address discharge occurs inside the discharge cells, to which the data signal Dp is supplied. Wall charge are formed inside the discharge cells selected by generating the address discharge to the extent that a discharge can occur when the sustain voltage Vs is supplied.

During a sustain period, the scan driver 200 and the sustain driver 300 supply sustain signals sus to the scan electrode Y and the sustain electrode Z, respectively. As a wall voltage inside the discharge cells selected by generating the address discharge is added to the sustain signal sus, every time the sustain signal sus is applied, a sustain discharge occurs between the scan electrode Y and the sustain electrode Z.

The sustain signal sus is a signal swing between the first voltage and the second voltage. The first voltage may be substantially equal to the ground level voltage GND, and the second voltage may be substantially equal to the sustain voltage Vs of the sustain signal sus.

After a last sustain signal is supplied during a sustain period of a last subfield of the plurality of subfields, the scan driver 200 may supply an erase signal.

Figure 5:
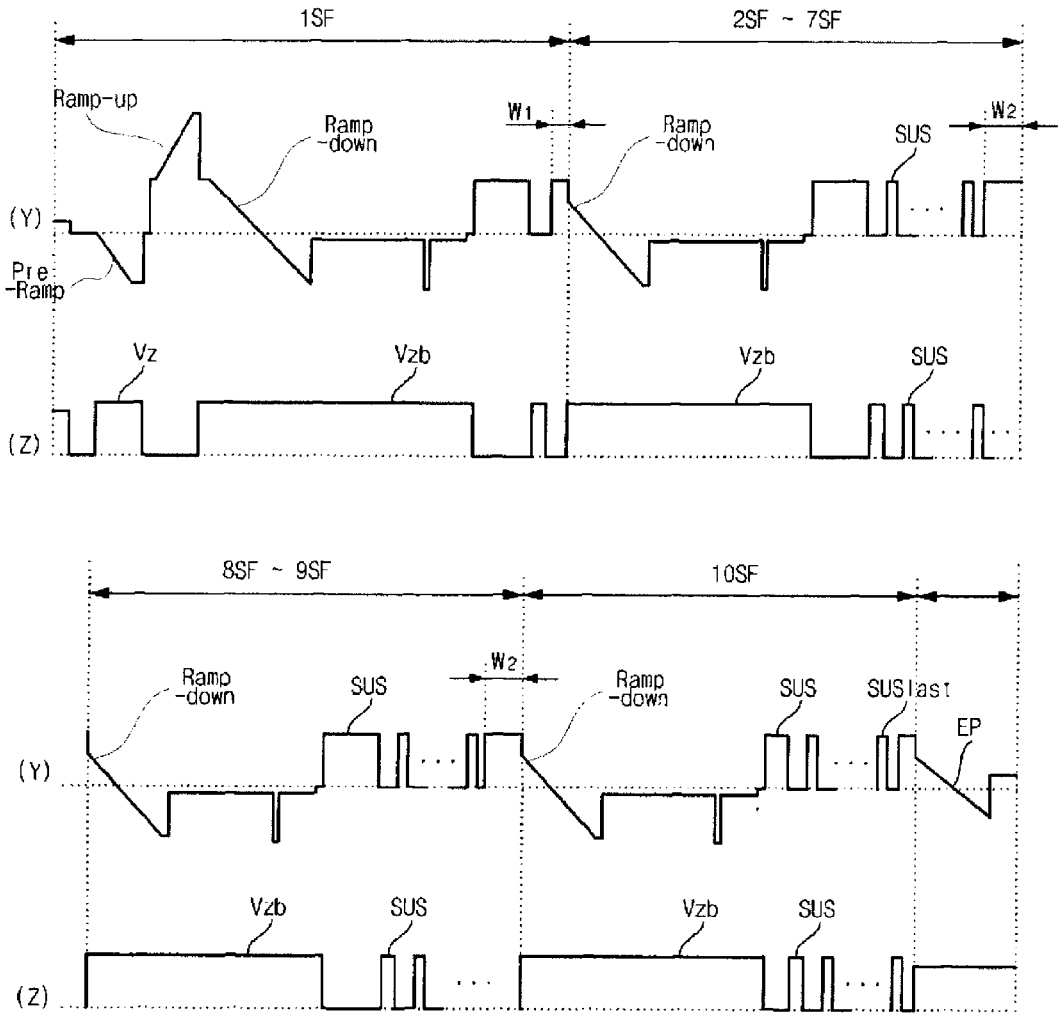
FIG. 5 is a diagram for explaining an implementation of driving signals supplied in a plurality of subfields.

FIG. 5 is a diagram for explaining an implementation of driving signals supplied in a plurality of subfields. Because a frame comprised of a plurality of subfields SF1 to SF10 was fully described with reference to FIG. 3, and the driving signals was fully described with reference to FIG. 4, the descriptions are omitted in FIG. 5.

As shown in FIG. 5, the scan driver supplies a first signal, which rises from a first voltage to a second voltage larger than the first voltage, is maintained at the second voltage during a predetermined period of time, and falls from the second voltage to a third voltage smaller than the first voltage with a slope, to the scan electrode Y. The predetermined periods of time in at least two subfields may be different from each other.

During a reset period of a first subfield SF1 of a frame, a reset signal including a reset rising signal Ramp-up and a reset falling signal Ramp-down is supplied to the scan electrode Y. During reset periods of the remaining subfields SF2 to SF10 except the first subfield SF1, a reset signal including only the reset falling signal Ramp-down is supplied to the scan electrode Y.

The first signal and a second signal may include a reset falling signal. The reset falling signal rises from the first voltage to the second voltage, is maintained at the second voltage during a first period W1 or a second period W2, and falls from the second voltage to the third voltage with a slope.

The first signal and the second signal are supplied during the reset periods of the remaining subfields SF2 to SF10 except the first subfield SF1. The first period W1 of the first signal, whose a voltage level is maintained at the second voltage, may be different from the second period W2 of the second signal, whose a voltage level is maintained at the second voltage.

The first signal is supplied earlier than the second signal during the reset periods of the remaining subfields SF2 to SF10 except the first subfield SF1. A length of the first period W1 of the first signal is shorter than a length of the second period W2 of the second signal.

For example, if one frame includes 10 subfields SF1 to SF10, a length of a first period W1 of the first signal supplied during reset periods of the 2nd to 7th subfields SF2 to SF7 is shorter than a length of a second period W2 of the second signal supplied during reset periods of the 8th to 10th subfields SF8 to SF10.

A reason why the length of the first period W1 is shorter than the length of the second period W2 is to prevent the center of light from moving to the first subfield. In other words, the center of light can move to the intermediately arranged subfield of the plurality of subfields of one frame.

Because the reset rising signal Ramp-up and the reset falling signal Ramp-Down are supplied in only the first subfield SF1, the wall charges may be unstably distributed inside the discharge cells in the subfields following the first subfield SF1. Therefore, the wall charges can be stably distributed by the second signal having the second period W2 longer than the first period W1.

A last sustain signal SUS_last of sustain signals Sus supplied to the scan electrode during a sustain period of a last subfield SF10 of a frame may be an erase signal. Hence, the last sustain signal SUS_last erases the most of non-uniformly distributed wall charges, and thus the remaining wall charges can be uniformly distributed inside the discharge cells.

Because a waveform and a function of the last sustain signal SUS_last may be substantially equal to waveforms and functions of the first and second signals, the last sustain signal SUS_last corresponding to the erase signal may be the first and second signals.

A length of the first period W1, a length of the second period W2, or the last sustain signal SUS_last may change depending on a gray level of an image.

FIG. 6 is a diagram for explaining a gray level and a maintenance period.

When a gray level of an image is smaller than 51% of a highest gray level of the image, the image gray level is referred to as a first gray level. When a gray level of an image is equal to or larger than 51% of a highest gray level of the image, the image gray level is referred to as a second gray level. The scan driver supplies the first signal in the first gray level and supplies the second signal in the second gray level.

If the highest gray level is 256 gray levels, a gray level corresponding to 51% of the highest gray level is 131 gray levels.

For example, an image capable of being displayed through 131 gray levels may be a dark image, an image whose a movement is small, an image in which changes in the screen being the entire background are small in as a nature documentary. These images can be sufficiently displayed through a low gray level.

Various values of a gray level are required to display an image on the plasma display panel. The image quality may depend on how many gray values are used to display an image. If many gray values are used so as to improve the image quality, power consumption may increase due to an excessive driving voltage. Therefore, it is advantageous that the number of gray values is used to display the image to the extent that the image quality is not reduced.

The length of the second period of the second signal supplied to the scan electrode in case of the second gray level is longer than the length of the first period of the first signal supplied to the scan electrode in case of the first gray level.

As above, because the first signal is supplied in the first gray level and the second signal is supplied in the second gray level, a reduction in the image quality can be prevented while the power consumption does not increase.

The second period W2 of the second signal is 3 to 5 times the first period W1 of the first signal. In other words, the second period W2 of the second signal may be 240 μs to 300 μs, and the first period W1 of the first signal may be 60 μs to 80 μs.

If the length of the first period W1 is substantially equal to the length of the second period W2, the center of light cannot be prevented from moving to the first subfield SF1 of the plurality of subfields constituting one frame. Further, because the reset rising signal Ramp-up and the reset falling signal Ramp-down are supplied in only the first subfield SF1 and only the reset falling signal Ramp-down is supplied in the subfields following the first subfield SF1, the wall charges may be unstably distributed inside the discharge cells.

If the length of the first period W1 is excessively shorter than the length of the second period W2, the center of light may move to the 8th to 10th subfields SF8 to SF10 of the plurality of subfields constituting one frame.

Accordingly, the second period W2 of the second signal may be 3 to 5 times the first period W1 of the first signal so as to uniformly distribute the wall charges inside the discharge cells while the center of light is maintained in one frame. In other words, the second period W2 of the second signal may be 240 μs to 300 μs, and the first period W1 of the first signal may be 60 μs to 80 μs.

Figure 7:
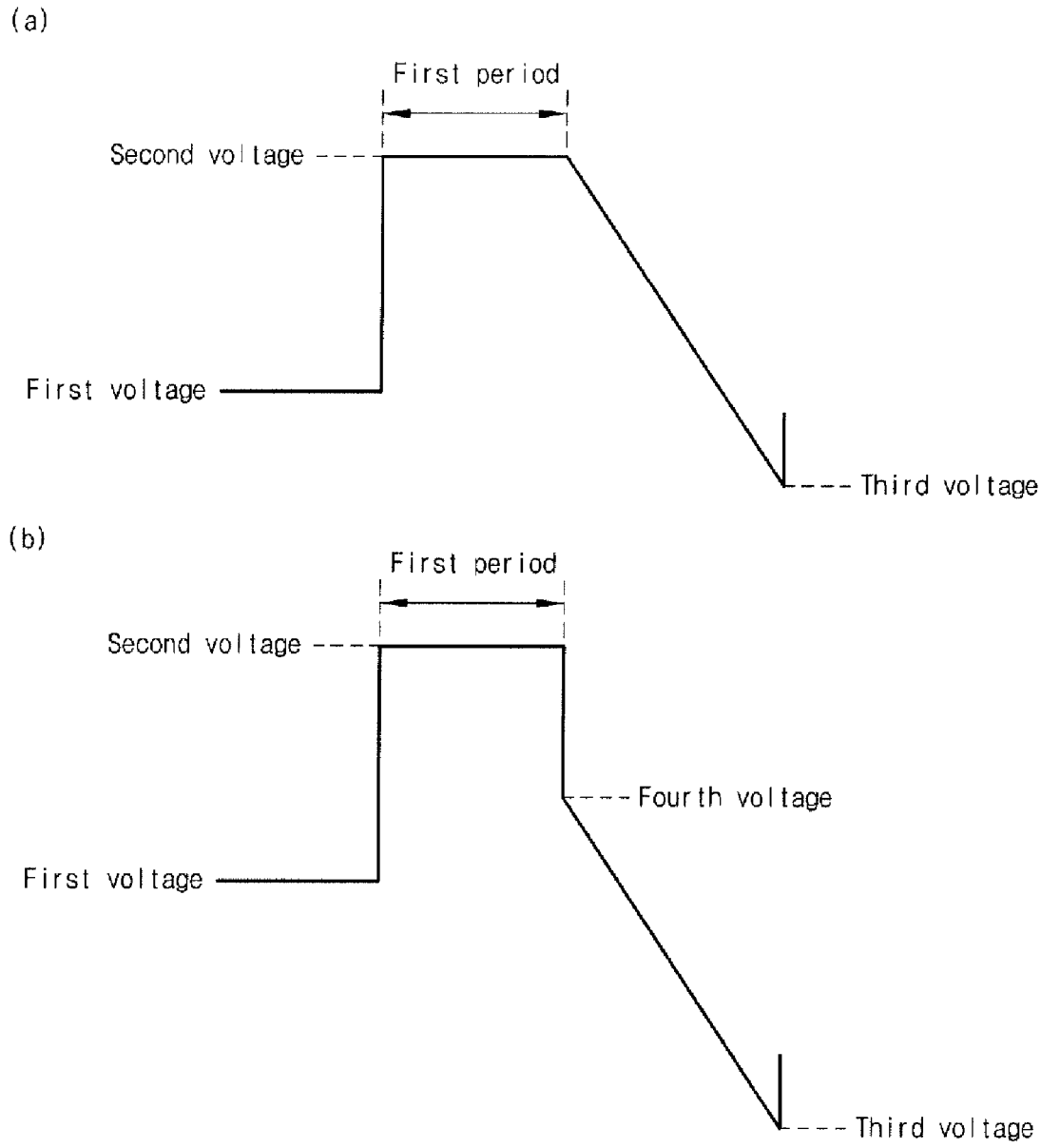
FIG. 7 is a diagram for explaining a first signal and a second signal.

FIG. 7 is a diagram for explaining the first signal and the second signal.

In FIG. 7, (a) shows the first signal which rises from the first voltage to the second voltage, is maintained at the second voltage during the first period, and gradually falls from the second voltage to the third voltage smaller than the first voltage. Because the first signal gradually falls from the second voltage to the third voltage, a reset discharge generated by the first signal can be minimized. Hence, a reduction in a contrast ratio can be prevented. The first voltage may be the ground level voltage, and the second voltage may be the sustain voltage.

In FIG. 7, (b) shows the first signal which rises from the first voltage to the second voltage, is maintained at the second voltage during the first period, sharply falls from the second voltage to a fourth voltage, that is smaller than the second voltage and larger than the third voltage, and slowly falls from the fourth voltage to the third voltage. The fourth voltage may be larger than the ground level voltage. Because the first signal sharply falls from the second voltage to the fourth voltage and slowly falls from the fourth voltage to the third voltage, a total length of the reset period can be reduced and a reset discharge generated by the first signal can be minimized.

Because the waveform of the first signal is substantially the same as the waveform of the second signal except that a period of the first signal whose the voltage level is maintained at the second voltage is different from a period of the second signal whose the voltage level is maintained at the second voltage, a description of the waveform of the second signal is omitted.

Accordingly, the first signal and the second signal can be supplied using the same voltage source, and thus the manufacturing cost can be reduced.

Figure 8:
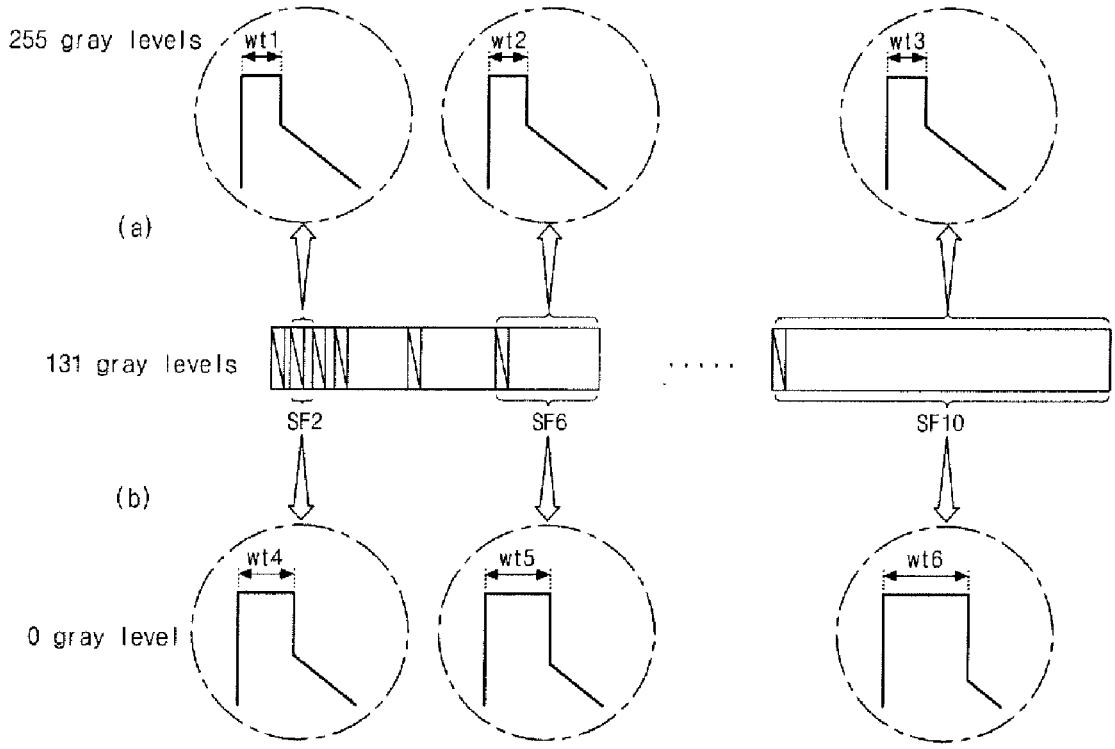
FIG. 8 is a diagram for explaining another implementation of driving signals supplied in a plurality of subfields.

FIG. 8 is a diagram for explaining another implementation of driving signals supplied in a plurality of subfields.

As shown in FIG. 8, the scan driver 200 supplies a first signal to the scan electrode Y. The first signal rises from a first voltage to a second voltage larger than the first voltage, is maintained at the second voltage during a predetermined period of time, and falls from the second voltage to a third voltage smaller than the first voltage with a slope.

The predetermined period of tire may be adjusted depending on a gray level of an image displayed on the screen.

Therefore, the predetermined period of time may change depending on image gray level in each of a plurality of subfields constituting one frame.

In other words, the predetermined period of time of the first signal may be adjusted depending on the image gray level in each of the remaining subfields except a first subfield of one frame. In FIG. 8, as the tire for one frame period has elapsed, the predetermined period of time of the first signal becomes longer.

In FIG. 8, (a) shows the first signal supplied in the subfields when a gray level of an image is equal to or larger than 51% of a highest gray level of the image, and (b) shows the first signal supplied in the subfields when a gray level of an image is smaller than 51% of a highest gray level of the image.

In (a) of FIG. 8, predetermined periods wt1, wt2, and wt3 of time of the first signal in the 2nd, 6th, and 10th subfields are substantially the same. On the contrary, in (b) of FIG. 8, a predetermined period wt4 of time of the first signal in the 2nd subfield is shorter than a predetermined period wt5 of time of the first signal in the 6th subfield, and the predetermined period wt5 of time of the first signal in the 6th subfield is shorter than a predetermined period wt6 of time of the first signal in the 10th subfield.

Figure 9:
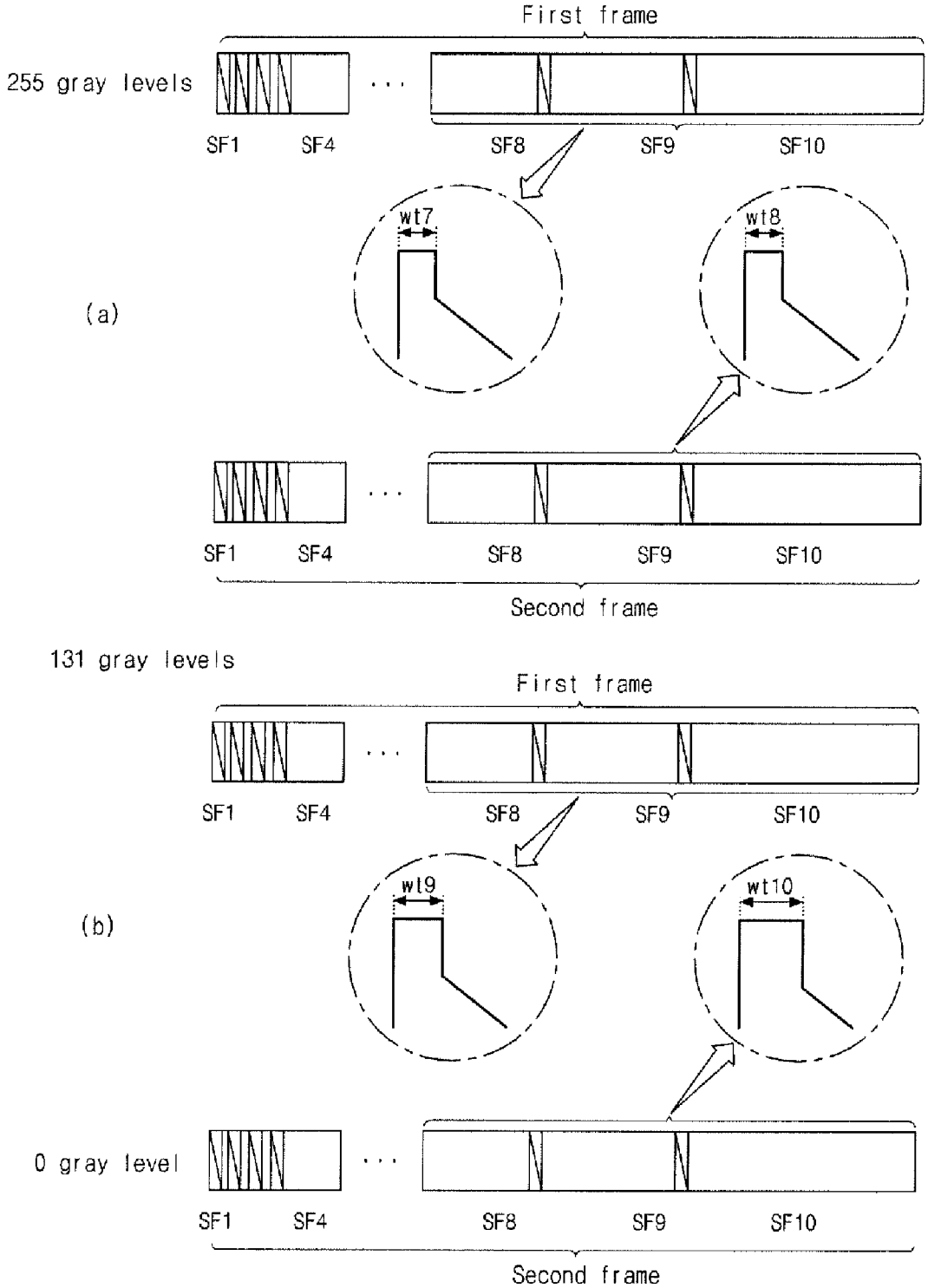
FIG. 9 is a diagram for explaining another implementation of driving signals supplied in a plurality of subfields.

FIG. 9 is a diagram for explaining another implementation of driving signals supplied in a plurality of subfields.

As shown in FIG. 9, a predetermined period of time of the first signal supplied during reset periods of the remaining subfields except a first subfield of a 1st frame may be different from a predetermined period of time of the first signal supplied during reset periods of the remaining subfields except a first subfield of a 2nd frame.

The second voltage is supplied during a first period in an n-th subfield of the 1st frame in case of the first gray level, and the second voltage is supplied during a second period in an n-th subfield of the 2nd frame in case of the second gray level.

In FIG. 9, (a) shows the first signal supplied in 8th to 10th subfields of each of the 1st and 2nd frames when a gray level of an image is equal to or larger than 51% of a highest gray level of the image, and (b) shows the first signal supplied in the 8th to 10th subfields of each of the 1st and 2nd frames when a gray level of an image is smaller than 51% of a highest gray level of the image.

In (a) of FIG. 9, a length of a first period wt7 of the second voltage in the 8th to 10th subfields of the 1st frame is substantially equal to a length of a second period wt8 of the second voltage in the 8th to 10th subfields of the 2nd frame. On the contrary, in (b) of FIG. 9, a length of a first period wt9 of the second voltage in the 8th to 10th subfields of the 1st frame is shorter than a length of a second period wt8 of the second voltage in the 8th to 10th subfields of the 2nd frame.

As above, because the second period of the second voltage in the second frame following the first frame is longer than the first period of the second voltage in the first frame, the light center can move to the intermediately arranged subfield of each frame. Hence, the wall charges can be uniformly distributed inside the discharge cells The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus driven in a frame comprised of a plurality of subfields, the apparatus comprising:

a plasma display panel including a scan electrode and a sustain electrode; and a driver configured to:

in a first subfield, supply a reset signal to a scan electrode including a ramp-up signal having a gradually rising voltage and a ramp-down signal having a gradually falling voltage to the scan electrode during a reset period of a first subfield, at an end of the first subfield or a second subfield, supply a first signal, that rises from a first voltage to a second voltage, is maintained at the second voltage during a predetermined period of time, perpendicularly falls from the second voltage to a fourth voltage smaller than the second voltage, and at a reset period of the second subfield or a reset period of a third subfield, falls from the fourth voltage to a third voltage smaller than the first voltage with a slope, wherein the first subfield precedes the second subfield, and the second subfield precedes the third subfield, wherein a length of the predetermined period of time of the third subfield is longer than a length of the predetermined period of time of the second subfield, wherein the predetermined period of time is a first period in the second subfield of a first frame in case of a first gray level, and the predetermined period of time is a second period in the second subfield of a second frame in case of a second gray level larger than the first gray level, and wherein a length of the second period is longer than a length of the first period.

2. The plasma display apparatus of claim 1, wherein the first, second, and third subfields are included in the frame.

3. The plasma display apparatus of claim 1, wherein the length of the second period is 3 to 5 times the length of the first period.

4. The plasma display apparatus of claim 1, wherein the driver includes a scan driver and a sustain driver, before the reset signal is supplied to the scan electrode during the reset period of the first subfield of the frame, the scan driver supplies a first falling signal to the scan electrode, and the sustain driver supplies a first rising signal to the sustain electrode during the supply of the first falling signal.

5. The plasma display apparatus of claim 1, wherein a sustain bias voltage is supplied to the sustain electrode during the supply of the first signal.

6. The plasma display apparatus of claim 1, wherein the second voltage is equal to a voltage of a sustain signal applied during a sustain period.

7. A plasma display apparatus driven in a frame comprised of a plurality of subfields, the apparatus comprising:

a plasma display panel including a scan electrode and a sustain electrode; and a driver configured to supply, in a first subfield, a reset signal to the scan electrode during a first reset period of a first subfield, the reset signal including a ramp-up signal having a rising voltage with a positive slope and a ramp-down signal having a falling voltage with a negative slope, the driver being further configured to supply to the scan electrode, at an end of the first subfield or an end of a second subfield, a first signal that rises from a first voltage level to a second voltage level, wherein the first signal is maintained at the second voltage level for a predetermined period of time, and after the predetermined period of time, the first signal decreases from the second voltage level to a fourth voltage level, wherein the fourth voltage level is less than the second voltage level, wherein at a beginning of the second subfield in a second reset period or a beginning of a third subfield in a third reset period, the first signal decreases from the fourth voltage level to a third voltage level that is less than the first voltage level, wherein a slope of the decrease of the first signal from the second voltage level to the fourth voltage level is steeper than a slope associated with the ramp-down signal, wherein the first subfield precedes the second subfield, and the second subfield precedes the third subfield, wherein a duration of the predetermined period of time of the third subfield is longer than a duration of the predetermined period of time of the second subfield, wherein the predetermined period of time is equal to a first period in the second subfield of a first frame in a case of a first gray level, and the predetermined period of time is equal to a second period in the second subfield of a second frame in a case of a second gray level, wherein the second gray level is larger than the first gray level, and wherein a duration of the second period is longer than a duration of the first period.

8. The plasma display apparatus of claim 7, wherein the first voltage level, the second voltage level, the third voltage level, and the fourth voltage level are all different voltage levels.

* * * * *